US005884913A

United States Patent [19]

Cohen

[11] Patent Number: 5,884,913

[45] Date of Patent: Mar. 23, 1999

[54] GOLF TEE SHOT-GREEN PLACEMENT MONITORING SYSTEM

[76] Inventor: Daniel E. Cohen, 1225 Tower Ave., Superior, Wis. 54880

[21] Appl. No.: 474,411

[22] Filed: Jun. 7, 1995

[51] Int. Cl.[6] ..... A63B 67/00

[52] U.S. Cl. ..... 273/176 A; 273/176 FA; 273/185 R; 273/185 A; 273/184 A; 273/34 R; 340/323 R

[58] Field of Search ..... 273/176 R, 176 A, 273/176 FA, 185 R, 185 A, 184 A, 34 R

[56] References Cited

U.S. PATENT DOCUMENTS

| | | | |
|---|---|---|---|
| 4,922,222 | 5/1990 | Baker | 273/34 R |
| 5,102,140 | 4/1992 | Vincent | 273/34 R |
| 5,354,052 | 10/1994 | Nicholls et al. | 273/34 R |
| 5,370,389 | 12/1994 | Reising | 273/35 B |
| 5,445,374 | 8/1995 | Clark | 273/34 A |

*Primary Examiner*—George J. Marlo
*Attorney, Agent, or Firm*—Schwartz & Weinrieb

[57] ABSTRACT

A golf tee shot-green placement monitoring system for monitoring golf tee shots to a designated green of a three-par golf course hole for determining the placement of such tee shots upon the green in connection with hole-in-one and closest-to-the-pin contests or challenges. The system comprises a club house base unit, a tee unit, and a green unit. Upon payment of a specified nominal fee, the participating golfer is issued a game card at the club house terminal. Upon reaching the designate three-par hole tee, the golfer inserts the card, or inputs encoded data, into the tee unit which then activates the green unit. Upon driving the tee shot, the green unit, comprising photodetectors and ultrasonic ranging devices, determines the achievement of a hole-in-one or the placement of the tee shot within specified distances from the cup or hole. If the golfer achieves a hole-in-one or places his tee shot within the specified distances from the hole or cup, prize money is awarded.

20 Claims, 5 Drawing Sheets

50
56
54
52
68
58
62
60
66
64
86

GOLF TEE SHOT-GREEN PLACEMENT MONITORING SYSTEM

FIELD OF THE INVENTION

The present invention relates generally to amusement systems, and more particularly to an amusement system which is especially designed for use in connection with a golf course for the purpose of monitoring and administering individual tee shots of individual golfers upon a designated golf course hole in connection with a contest of skill for which prize money is awarded.

BACKGROUND OF THE INVENTION

Golf has become one of the world's favorite pastime and recreational activity. There are more than fourteen thousand golf courses within the United States, according to the National Golf Foundation, and of these courses, more than twelve thousand are listed with the United States Golf Association. The game of golf was played by more than twenty-four million people in the United States in 1991 according to statistics compiled by means of the United States Golf Association, and these golfers played more than four hundred seventy-nine million rounds of golf. Golfers comprise one of the most diverse market populations of any recreational sport. The average golfer spends in excess of two hundred fifty dollars per year for equipment, not including golf balls, and more than two hundred dollars per year in green fees.

While most golfers will certainly agree with the premise that golf can be quite challenging, and can certainly be frustrating at times, it is felt that an additional "challenge" for the golfers is needed, particularly if such is considered from the viewpoint of a combination of skill, amusement, and the potential for remuneration. In particular, in order to impart additional interest or additional competition to a round of golf, not only for an individual golfer who may be a sole participant, but also for a group of golfers playing together, the present invention contemplates and implements a mini-tournament or contest integrally incorporated within the overall round of golf so as not to interfere at all with the overall round of golf, or upset the continuity of the round of golf for the tournament or contest participants or for the non-participating members of the golfing group, or hinder other groups of golfers who may subsequently follow the tournament or contest participants. In particular, the present invention contemplates the implementation and monitoring of a hole-in-one golf competition either for a sole participating golfer or a plurality of golfers playing within a group of golfers. Concomitant to the hole-in-one competition, the present invention likewise contemplates the implementation and monitoring of a golf competition comprising golf tee shots upon a predetermined par-three golf hole wherein golfers can effectively be winners of the competition by placing their tee shots within specified distances from the hole or cup, such as, for example, within one, two, or three feet of the hole or cup.

The present invention therefore comprises and embodies a system for implementing and monitoring the above-identified hole-in-one and concomitant green placement golf tee shots in connection with the aforenoted hole-in-one and pin-closeness golf shot competitions or contests.

OBJECTS OF THE INVENTION

Accordingly, it is an object of the present invention to provide a new and improved amusement system.

Another object of the present invention is to provide a new and improved amusement system which is especially designed for use in connection with the sport of golf.

Still another object of the present invention is to provide a new and improved amusement system which presents an additional "challenge" to one or more golfers during a round of golf.

Yet another object of the present invention is to provide a new and improved amusement system which effectively establishes and monitors a mini-tournament or contest which is uniquely integrally incorporated within an overall round of golf.

Still yet another object of the present invention is to provide a new and improved amusement system wherein the mini-tournament or contest is uniquely incorporated within the round of golf so as not to interfere with the overall round of golf, or upset the continuity of the round of golf, or hinder other groups of golfers who may subsequently follow the tournament or contest participants.

Yet still another object of the present invention is to provide a new and improved amusement system wherein the mini-tournament or contest established and monitored by the system comprises a hole-in-one contest.

A further object of the present invention is to provide a new and improved amusement system wherein the mini-tournament or contest established and monitored by means of the system comprises the placement of tee shots, upon a predeterminedly designated par-three hole of the golf course, within specified distances of the hole or cup.

SUMMARY OF THE INVENTION

The foregoing and other objectives are achieved in accordance with the present invention through the provision of a golf tee shot-green placement monitoring system which basically comprises three different units or systems interrelated together by means of suitable communication links. More particularly, the system comprises a base unit located within the golf course club house, a tee unit located upon the tee of the predetermined three-par hole of the golf course upon which the contest or tournament will be played, and a green unit which is located upon the green of the predetermined or selected three-par hole.

The base or club house unit manages the operation of the system by issuing game or contest cards, activating the tee unit, validating or verifying winning golf shots as determined by means of the green unit, and transferring all information concerning the operation of the entire system to a central computer which may be located either within the club house or at a remote location. The game or contest cards may either be cards having a validation number printed thereon in alphanumeric form or cards containing an encoded magnetic strip or bar code.

The tee unit comprises a standard supported upon a base and having a communication unit supported thereon. An audiosensor is located within the base for detecting the drive of a golf ball from the tee and for activating the green unit in response to the detected sound accompanying the tee shot. The communication unit comprises a keypad and a card reader for inputting the game card validation number or reading the game card data, respectively, depending upon the type of game cards actually issued or used, and a display unit for displaying instructions to the golfer as to the use of the system once the golfer is at the predetermined or selected tee and is ready to participate in the contest or tournament The green unit comprises a modified hole unit or cup, and a modified flag pole holder. A photodetector is located within the hole unit or cup so as to detect a hole-in-one golf ball tee shot, and the flag pole holder comprises suitable sensors, such as, for example, ultrasonic detectors, for determining positions of golf balls upon the green and within specified distances from the hole or cup unit in accordance with the contest or tournament rules. Information as to successful hole-in-one tee shots or with respect to golf ball tee shots successfully placed onto the green within the specified distances from the hole or cup is transmitted to the tee unit for input and storage within the tee unit computer, and such data is also displayed upon the display of the tee unit so that the golfer participating in the contest or tournament knows the status of his tee shot. This data may also be retrieved from the tee unit computer by the club house or base unit. The green unit further comprises motion detectors similar to those employed in intrusion detection systems for detecting, for example, human personnel upon or within specified distances of the predetermined or selected green for security purposes in connection with the valid operation of the system. In other words, such devices will prevent golfers or other personnel from fraudulently tossing or hitting golf balls onto the green in order to fraudulently "win" the contest or tournament. Cameras, arranged in suitable triangulation modes, may also be employed upon the tee and green areas in order to serve similar security purposes.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
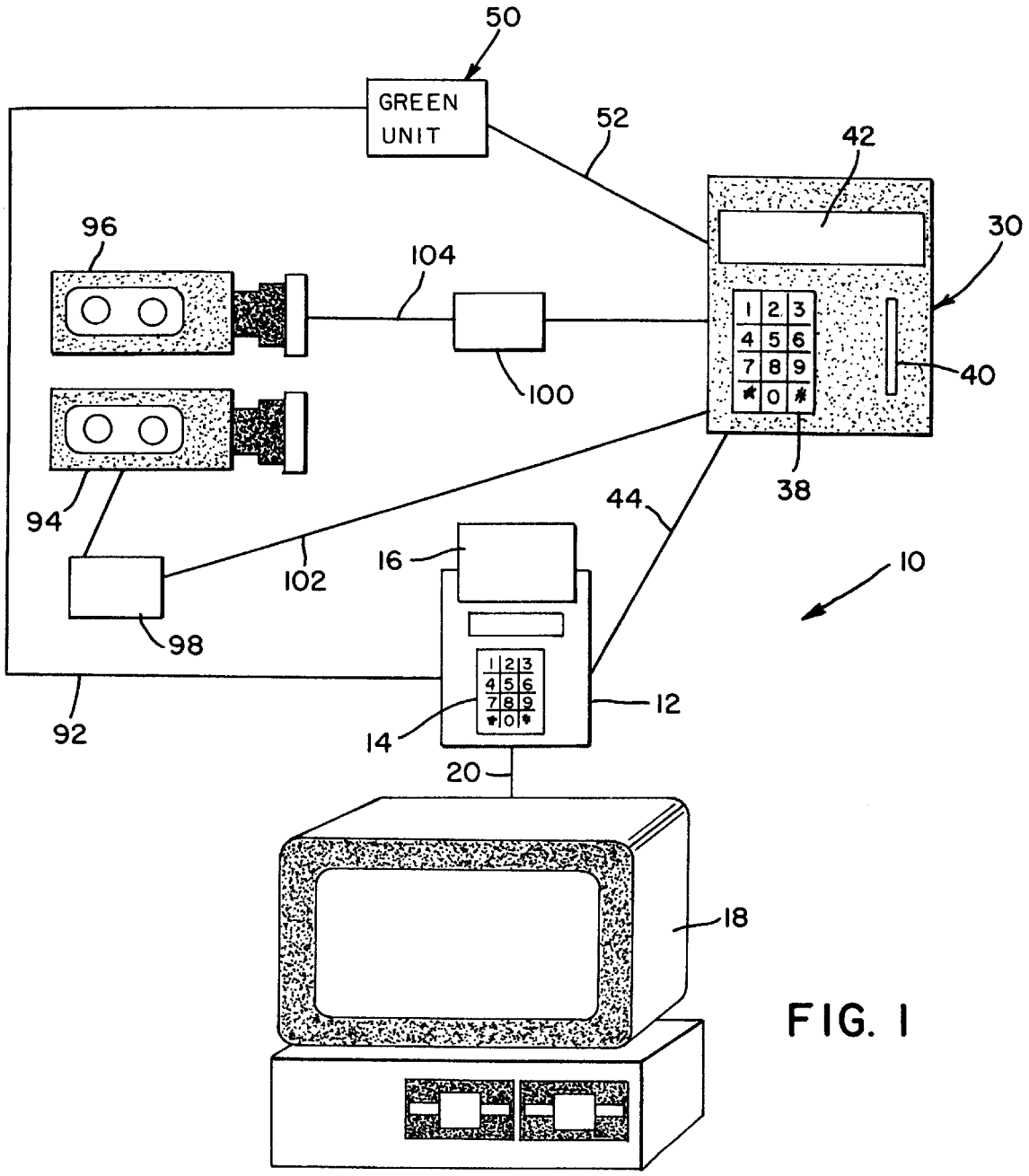
FIG. 1 is a schematic drawing illustrating the overall golf tee shot-green placement monitoring system of the present invention.

Referring now to the drawings, and more particularly to FIG. 1 thereof, the new and improved golf tee shot-green placement monitoring system constructed in accordance with the present invention is illustrated in FIG. 1 and is generally indicated by the reference character 10. The system 10 is constructed so as to, in effect, establish and monitor a hole-in-one challenge for participating golfers wherein the hole-in-one challenge is to be played upon a particular, predetermined or selected hole of the particular golf course upon which the system of the present invention has been installed. Concomitantly with the hole-in-one challenge, the system of the present invention also automatically establishes and monitors a challenge or contest for the participating golfers in which, for those tee shots which do not comprise holes-in-one, the tee shots are considered to be winning tee shots, on a graduated scale, if the tee shots land upon the green within specified distances from the hole or cup of the particular, predetermined or selected hole of the golf course, such as, for example, within one, two, or three feet of the hole or cup. The hole-in-one and closest-to-the-pin challenges or contests are entered into by participating golfers prior to the start of their particular round of golf at a particular participating or selected golf course upon which the system of the present invention has been installed. The round of golf must comprise a complete eighteen-hole round of golf, and prior to tee off at the first hole, such as, for example, when the golfer is paying his green fee at the club house, or confirming his tee-off time, the golfer pays an additional nominal amount of money, such as, for example, two dollars ($2.00) or four dollars ($4.00) in return for which if the golfer achieves a hole-in-one at the predetermined hole of the golf course, he will receive prize money commensurate with the amount of money he initially paid. For example, if he pays two dollars ($2.00), and he achieves a hole-in-one at the pre-selected hole of the golf course, he wins a prize of two thousand dollars ($2,000.00), whereas if he initially pays four dollars ($4.00), and he achieves a hole-in-one at the pre-selected hole of the golf course, he wins a prize of four thousand dollars ($4,000.00). Of course, it is to be understood that the particularly established fees and prizes may be varied as determined by means of the management of the particular golf course upon which the system of the present invention is installed.

Continuing further, for those tee shots that do not become holes-in-one, prizes may be awarded upon a graduated scale, and depending upon the initial amount of money paid by the golfer, for tee shots landing upon the green within the aforenoted specified distances from the hole or cup. For example, if the golfer initially paid two dollars ($2.00), he would be paid prize money of fifty dollars ($50.00), seventy-five dollars ($75.00), or one hundred dollars ($100.00) if he places his ball within three, two, or one foot distances, respectively, from the cup or hole. Similarly, if the golfer initially paid four dollars ($4.00), he would be paid prize money of one hundred dollars ($100.00), one hundred fifty dollars ($150.00), or two hundred dollars ($200.00) if he places his tee shot within three, two, or one foot distances, respectively, from the cup or hole. Again, of course, such fees and prize monies may vary depending upon the particular management of the particular golf course upon which the system of the present invention is installed. Still further, additional hole-in-one or closest-to-the-pin contests or challenges may be established or arranged by the particular golf course while still using the system of the present invention. For example, in addition to the daily hole-in-one and closest-to-the-pin contests, an annual hole-in-one and closest-to-the-pin contest may be held for all previous hole-in-one and closest-to-the-pin winners who have won prizes within the past year. Still further, in connection with the closest-to-the-pin contests or challenges, payments or prizes may be based, again at the discretion of the particular management of the particular golf course upon which the present invention system is installed, either upon the premise that anyone placing a tee shot within one, two, or three feet of the cup or hole receives prize money, or alternatively, only the best or closest tee shot within a group of golfers playing together wins the prize money, or still further, only the best or closest tee shot recorded within a particular day of golf entitles that golfer to receive prize money. It is to be understood that the present invention is not directed toward establishing the particular fees or the rules under which the particular prizes are to be awarded, but to the contrary, the present invention is directed toward the system for establishing and monitoring the hole-in-one and closest-to-the-pin challenges or contests.

Referring then, again, to FIG. 1 in order to better appreciate the present invention 10, the system of the present invention is set up or arranged for operation in connection with only one predetermined or pre-selected par-three hole of the particular golf course upon which the system of the present invention is installed. Prior to starting a round of golf, if a particular golfer chooses to participate in the hole-in-one or closest-to-the-pin challenge, he will pay a nominal fee as noted hereinabove, such as, for example, two dollars ($2.00) or four dollars ($4.00), at a special terminal 12 which is located within the golf course club house. In return for this special challenge or contest fee, the golfer is issued a ticket or card which specifically identifies that particular golfer, the amount of money paid, the date and time, the golfer's tee-off time, and any additional information which may be deemed pertinent or necessary in order to identify that particular golfer and to distinguish him from other golfers. In particular, the terminal 12 may comprise a key-pad 14 and a printer 16. The aforenoted information concerning the particular golfer is entered into the terminal 12 by means of the keypad 14, the terminal 12 comprising a suitable computer and memory storage, not shown, and a ticket or card having the pertinent information encoded thereon will be issued by the printer 16. The ticket or card issued by the printer 16 may have the aforenoted information printed thereon in alphanumeric form, or alternatively, the issued card may be of the type having the information encoded thereon in the form of a bar code or magnetic strip. The information concerning the particular golfer and his particular transaction is also transmitted from the club house terminal 12 to a central computer 18 by means of a suitable communication link or line 20 which may optionally be any one of several different conventionally available communication lines or links, such as, for example, a direct hardwire link, a link using existing power lines, a radio frequency (RF) link, such as, for example, a wireless modem or local area network, or the like. The central computer 18 may be located within the golf course club house or at a remote location.

Figure 2:
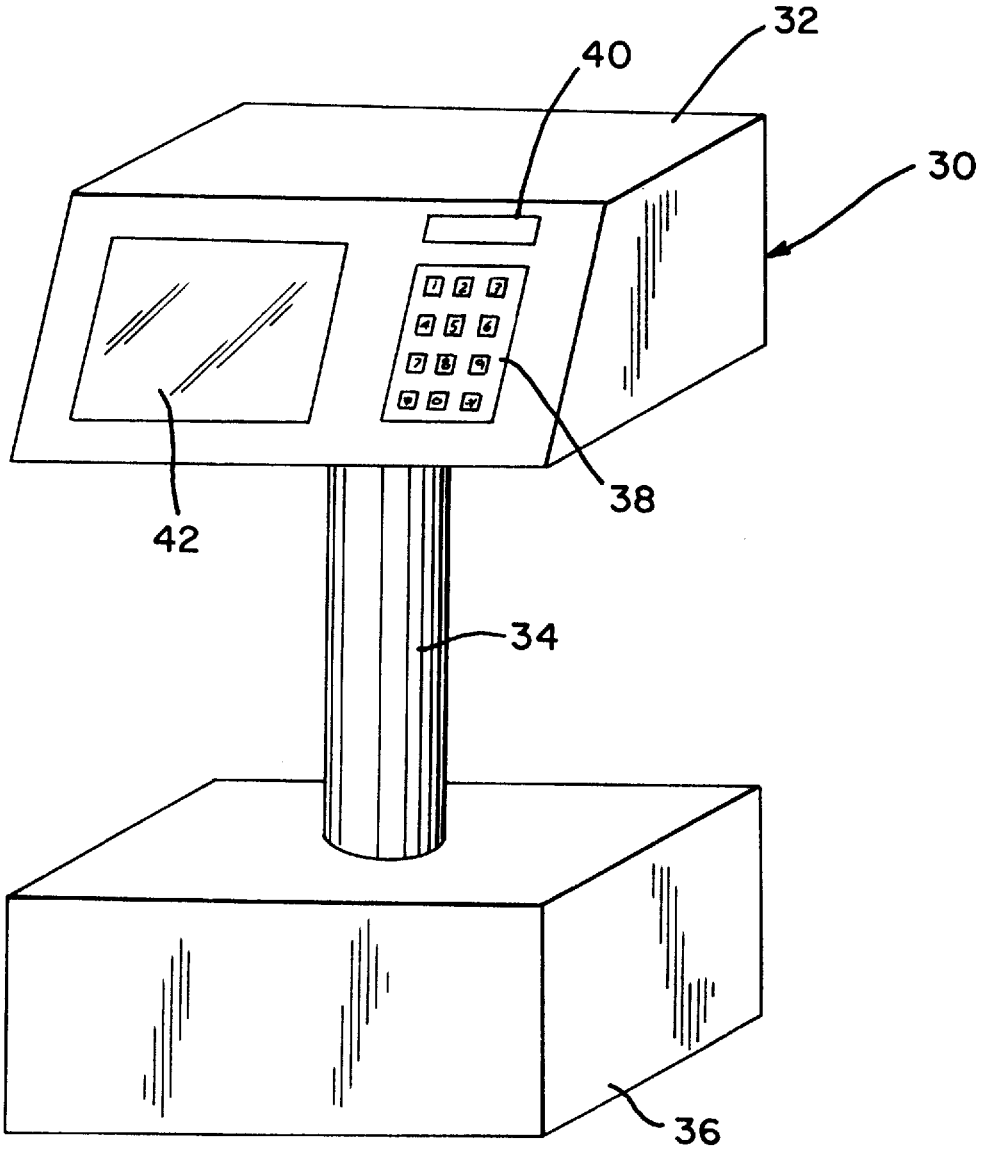
FIG. 2 is a front perspective view of the tee unit component of the system of the present invention as illustrated in FIG. 1 and as located at the predetermined or selected tee.
Figure 3:
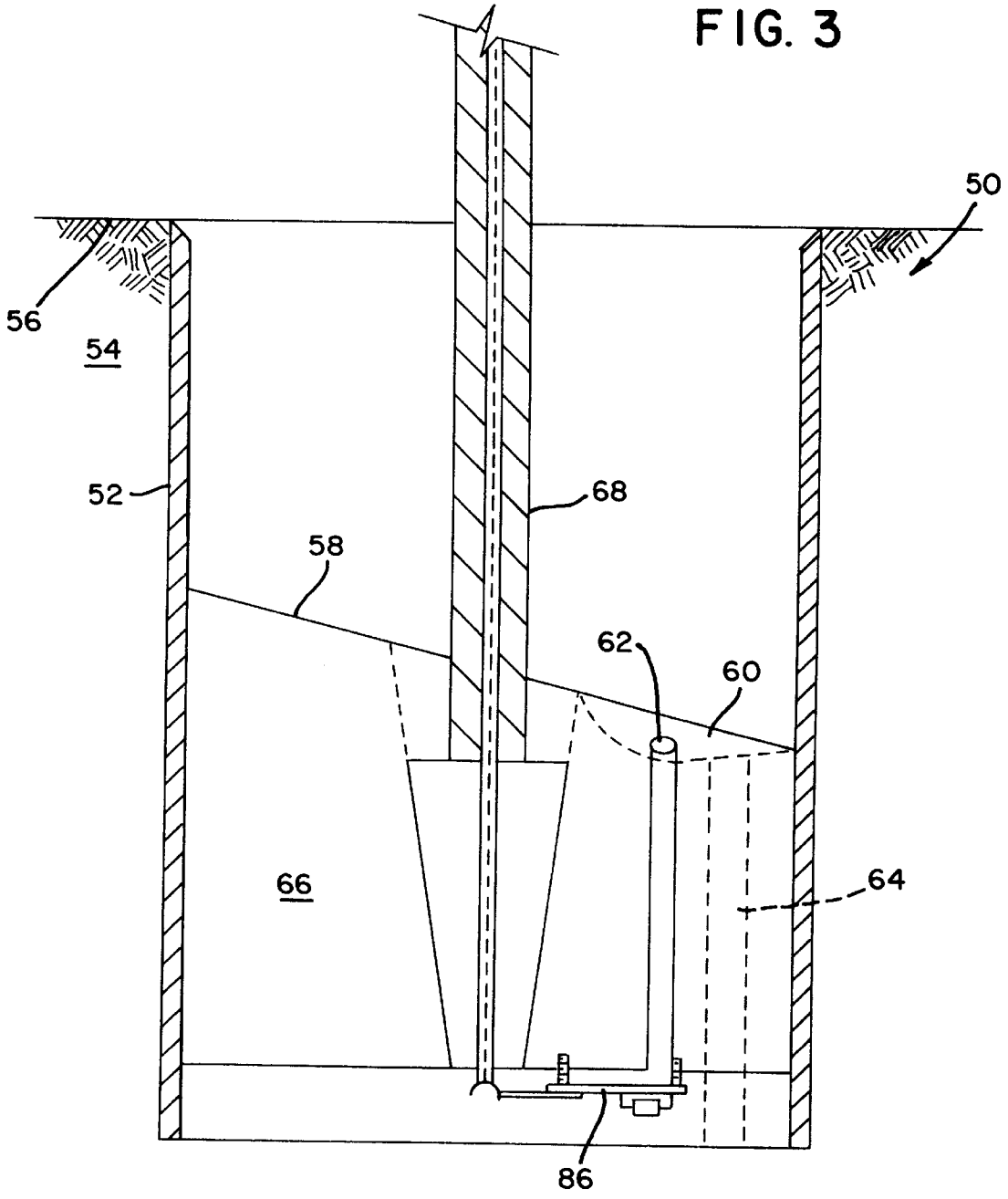
FIG. 3 is an elevational view, partly in cross-section, of the hole or cup unit component of the system of the present invention as illustrated in FIG. 1 and as located upon the green of the predetermined or selected hole of the golf course.
Figure 4:
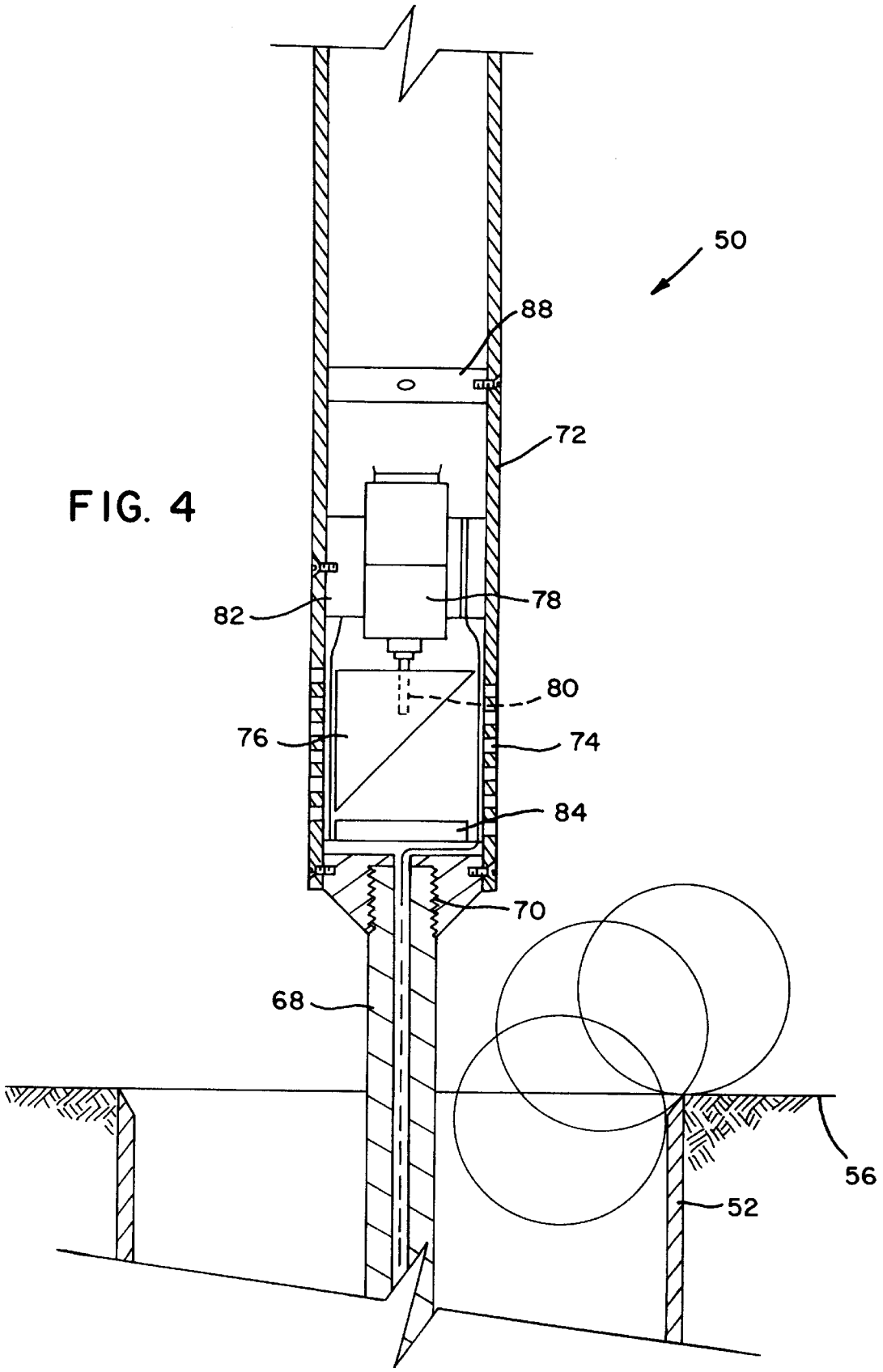
FIG. 4 is an elevational view, partly in cross-section, of the flag pole unit component of the system of the present invention as illustrated in FIG. 1 and as utilized in conjunction with the hole or cup unit component of the system of the present invention as illustrated in FIG. 3 and as located upon the green of the predetermined or selected hole of the golf course.
Figure 5:
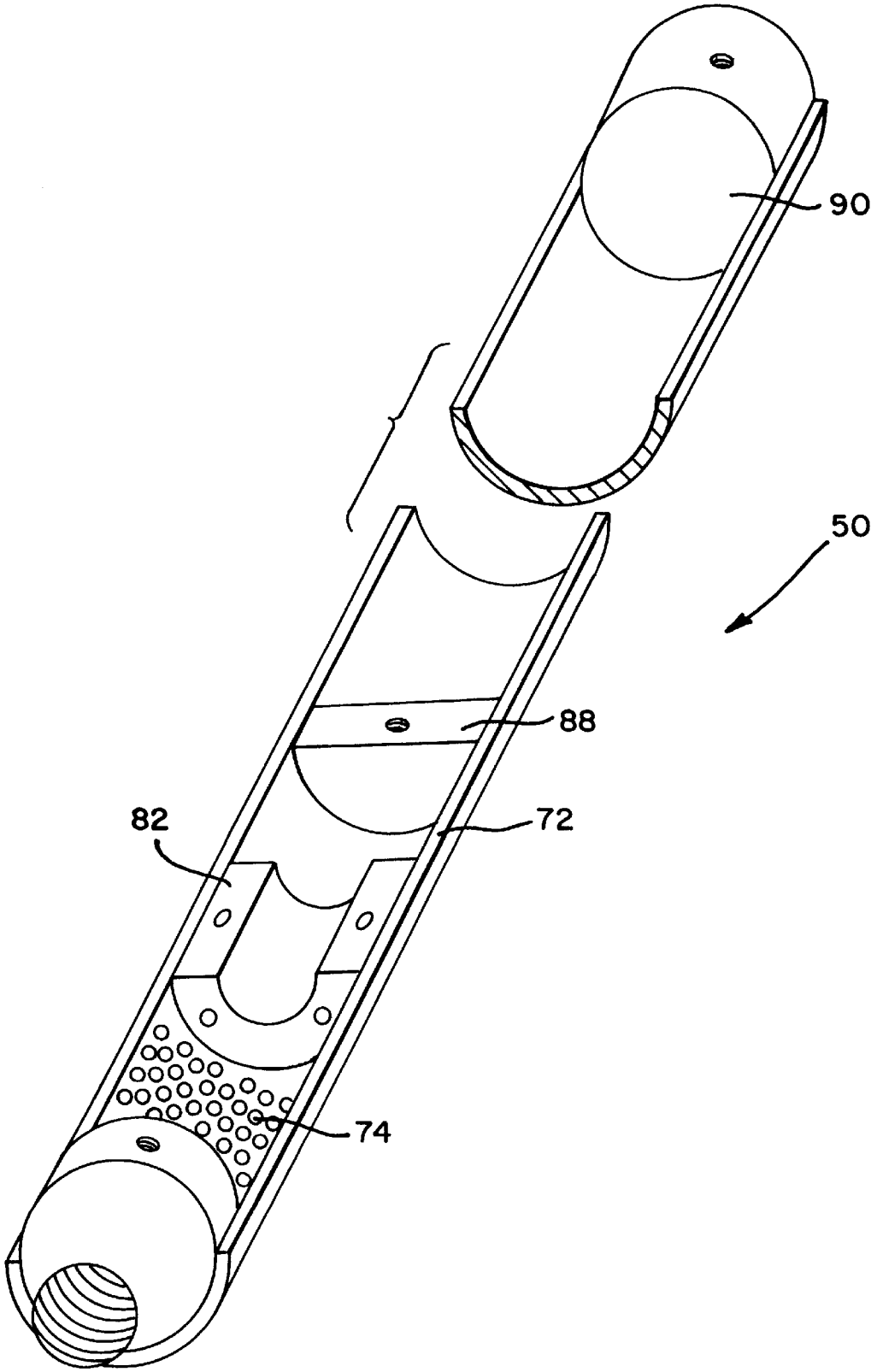
FIG. 5 is a perspective view of the flag pole unit component of the system of the present invention as illustrated in FIG. 4.

With reference now being made additionally to FIG. 2, when the participating golfer comes to the particular, predetermined or pre-selected par-three hole of the golf course upon which the challenge or contest implemented by means of the present invention is to be played, he will approach a tee unit of the system which is located within or immediately adjacent to the tee area of the par-three hole, and which is generally indicated by the reference character 30. As best seen in FIG. 2, the tee unit 30 comprises a housing 32 within which suitable computer communication and data storage memory components, not shown, are housed, and the housing 32 is fixedly mounted upon a standard 34 which, in turn, is fixedly mounted upon a base or foundation unit 36. The housing 32 is further provided with a keypad 38, a card reader, 40, and a display window or screen 42. As best seen in FIG. 1, the tee unit 30 is provided with a communication link or line 44, which may be of any one of the types of communication systems discussed in connection with the communication link or line 20, and it is seen that the communication link or line 44 provides communication between the tee unit 30 and the club house terminal 12. In this manner, when the particular golfer has purchased a contest or challenge ticket or card at the golf course club house, the information concerning his purchase, as encoded upon the ticket or card issued by the printer 16, is transmitted to the computer memory of the tee unit housing 32. Consequently, when the particular golfer is on the predetermined or preselected par-three golf tee area, if the card he received from the club house terminal printer 16 is of the type comprising alphanumeric information, he can insert such information into the tee unit computer by means of the tee unit keypad 38. Alternatively, if the card the golfer received from the club house terminal printer 16 is of the magnetic strip or bar code type, the golfer may simply insert the card within the tee unit card reader 40. In either case, the computer memory of the tee unit housing 32 will receive such inputted data, compare the same with the information previously transmitted thereto by means of the computer of the club house terminal 12, and verify or validate such data thereby permitting the golfer to in fact participate in the challenge or contest. The display window or screen 42 provides instructions to the golfer as to how to activate the system, that is, use the keypad 38 or card reader 40, and in addition, when the entry data is verified or confirmed, the display window or screen 42 will provide the golfer with further instructions as to commencement of his golf tee shot. The base or foundation unit 36 of the tee unit 30 is provided with a suitable sound detection means, not shown, for sensing when the particular golfer challenge or contest participant has driven his ball from the golf course tee of the predetermined or preselected hole. As a result of such sound accompanying the drive of the golf ball off the tee, the tee unit 30 activates a green unit located upon the green of the predetermined or preselected par-three golf course hole and generally indicated by the reference character 50 which is schematically illustrated in FIG. 1, and components of which are illustrated in FIGS. 3–5. Communication between the tee unit 30 and the green unit 50 is provided by means of a communication link or line 52, which may be similar to the communication links or lines 44 and 20, and it is to be noted that all of such communication links or lines 20, 44, and 52 are of course operable for two-way communication modes.

Referring now to FIGS. 3–5, the green unit of the present invention is illustrated within such figures and is generally indicated by means of the reference character 50 as is schematically illustrated in FIG. 1. As best seen in FIG. 3, the green unit 50 comprises a cup member 52 similar to a conventional golf course green hole cup wherein the cup member 52 is fixedly mounted within the ground 54 so as to be disposed below ground level 56. Inside the cup 52, there is disposed an inclined ramp portion or member 58, and at the lower end or side of the inclined ramp or surface 58 there is provided a substantially semi-circular recessed portion 60. In this manner, when the golf ball enters the cup 52, regardless of the circumferential position at which the ball actually enters the cup 52, the ball will be forced, under the influence of gravity, to be seated within the recessed portion 60. In order to detect the presence of the ball within the cup member 52, and more particularly, in order to sense the presence of the ball within the recessed portion 60 of the cup member 52, a photodetector aperture 62, with which a photodetector is operatively associated, is provided within a sidewall portion of the cup member which defines the recessed portion 60. In this manner, when the participating golfer achieves a hole-in-one, this situation can be readily detected. Water drain holes, only one of which is shown, may be provided within the cup member 52 as at 64 for the drainage of any water from the cup 52 into the surrounding ground 54.

A flag pole holder is provided for use in connection with the cup member 52, and as best seen from FIG. 3, the flag pole holder comprises a base member 66 fixedly mounted within the lower portion of the cup member 52, and it is seen that the upper surface of base member 66 is defined by means of the inclined ramp portion 58. A lower flag pole section 68 is fixedly mounted within the base member 66 such that the lower flag pole section 68 extends vertically upwardly therefrom. With reference being additionally made to FIG. 4, it is seen that the upper end of the lower flag pole section 68, which is disposed just above the ground line level 56, is threaded as at 70 so as to be threadedly connected to, and thereby support, the lower end of the upper flag pole section 72. With additional reference also being made to FIG. 5, it is seen that the lower end portion of the upper flag pole section 72 is provided with an annular array of apertures 74 provided throughout the entire circumferential extent of such lower end portion of the upper flag pole section 72. In conjunction with such apertures 74, a rotary reflector 76 is rotatably mounted at an axial position within the lower end portion of the upper flag pole section 72 which corresponds to the axial disposition of the array of apertures 74. A motor 78 is fixedly mounted within the upper flag pole section 72 at an axial position disposed above the reflector 76, and the motor 78 and reflector 76 are fixedly connected together by means of a motor shaft 80 such that rotation of the motor shaft 80 by the motor 78 rotates the reflector 76. The motor 78 is fixedly mounted within the upper flag pole section 72 by means of a suitable motor clamp mechanism comprising half-clamp members 82. A transceiver 84 is disposed within the lower end portion of the upper flag pole section 72 at an axial position which is immediately below the rotary reflector 76. The transceiver 84 is provided for transmitting and receiving ultrasonic signals in accordance with communication principles similar to SONAR. Signals transmitted or emitted by means of the transceiver 84 will be reflected by means of the rotary reflector 76 in a continuous sweep mode, and signals received by the rotary reflector 76 will be transmitted back to the transceiver 84. In this manner, when the green unit 50 is activated by means of the tee unit 30, motor drive 78 rotates the reflector 76 and the transceiver 84 emits ultrasonic signals therefrom. When a golf ball is driven from the tee of the designated golf hole and lands upon the green area of such golf hole, the ultrasonic signals emitted by the transceiver 84 will be reflected by such golf ball, reflected by means of the rotary reflector 76, and transmitted back to the transceiver 84. In this manner, not only will the golf ball be able to be detected, but its position from the cup or hole will be able to be determined in accordance with conventional SONAR ranging techniques.

It is to be appreciated that in accordance with the foregoing, suitable means may be incorporated within the system described in order to monitor the prevailing ambient temperature upon the golf course, and particularly upon the green area of the predetermined or preselected golf hole, in order to compensate for any changes in the speed of sound as a function of air temperature so as to insure as much as possible the distance values of the golf balls from the hole or cup as measured by means of the foregoing SONAR system. It is to be further understood that in lieu of a SONAR or ultrasonic type system, other systems may of course be employed, such as, for example, one using radio waves and operating upon RADAR principles, video systems, and the like. Still further, in lieu of the separate reflector and transceiver components 76 and 84, a single component, such as, for example, a rotary reflector having a transceiver integrally incorporated therein, may be envisioned.

With reference still being made to FIGS. 3–5, a printed circuit board holder 86 is mounted within the lower end of the cup member 52, and another printed circuit board holder 88 is disposed within the upper flag pole section 72 at an axial position above the motor 78. Printed circuit boards, not shown, mounted upon such printed circuit board holders 86 and 88 are provided in order to provide electrical connections and communications between the photodetector, the ultrasonic transceiver, and a suitable computer memory, not shown, provided within the green unit 50. In this manner, appropriate data concerning detection of the golf balls, either within the cup member 52 or upon the green, may be determined and processed. For example, the detection of a newly driven ball onto the green must be detected, its distance determined, such ball must be differentiated from previous balls driven onto the green, and the like. As seen in FIG. 5, the upper end of the upper flag pole section 72 is provided with a support member 90 which is provided for insertion of the golf course hole flag as well as for housing a communication antenna, not shown, by means of which the green unit 50 can communication with the tee unit 30 or the club house terminal 12. A communication link or line is schematically shown at 92 in FIG. 1 as extending between the green unit 50 and the club house terminal 12, and it is again noted that such communication link or line 92 may be similar to the communication links or lines 20, 44, and 52. Electrical power for all components of the system of the present invention can be provided by means of existing power lines and facilities adjcent to or upon the particular golf course, or alternatively, the various components of the system can be provided with electrical power by means of suitable rechargeable batteries, not shown, incorporated within the various main or primary units of the system. For example, batteries may be physically incorporated within the base unit 36 of the tee unit 30, or within the upper flag pole section 72 at an axial position located between the printed circuit board holder 88 and the flag pole support member 90.

It is lastly noted that for security purposes in connection with the accurate monitoring of the golf challenge or tournament, that is, in order to insure the legitimacy of a particular golf tee shot to the predetermined or preselected golf course green, video cameras 94 and 96, shown schematically in FIG. 1, may be provided upon or within the immediate vicinity of the tee area, and similarly, upon or within the immediate vicinity of the green area. In this manner, the particular golf drive tee shot of the particular participating golfer may be videotaped in its outbound mode from the tee area and substantially simultaneously videotaped in its inbound mode from the green area. While only one camera 94 and 96 is schematically illustrated in FIG. 1 as being provided at or within the vicinity of the tee and green areas, respectively, it is to be appreciated that several cameras at each location may be employed, if desired, so as to capture, in effect, a panoramic view of the tee and green areas, or such cameras may be utilized in accordance with triangulation techniques, so as to further insure security against, for example, golf balls being illegitimately placed, tossed, driven, or the like, onto the particularly designated green. Suitable camera controllers 98 and 100 are operatively associated with the cameras 94 and 98, and communication links or lines 102 and 104 connect the cameras 94 and 96 to the tee unit 30. Consequently, once the tee unit 30 is activated by the participating golfer inserting his card into card reader 40 or by inputting his encoded data into the tee unit 30 by means of keypad 38, the tee unit 30 will activate the cameras 94 and 96 in anticipation of the golf tee shot of the participating golfer. As a further means of insuring security as to legitimacy of the golf tee shots placed upon the green of the designate hole, conventional motion or intruder detectors, not shown, may be installed upon or within the immediate vicinity of the designated green. Such detectors may be activated and deactivated in accordance with predetermined timed schemes such that within a predetermined time period commencing, for example with the activation of the tee unit 30, no person is permitted to be within a specified distance or vicinity of the designated green.

Having now described the various structural components of the system of the present invention, a brief description of the operation of the system will be provided. When a particular golfer choose to participate in the hole-in-one or closest-to-the-pin contest or challenge upon the particular par-three hole of the designate golf course, the golfer will pay the predetermined aforenoted fee at the club house terminal 12 when, for example, he pays his green fee or is about to tee off at the first tee in accordance with his prearranged tee-off time. Upon receiving his game card from the printer 16, the club house terminal 12 records the transaction and transmits the details of the transaction to the tee unit 30. When the golfer reaches the tee area of the predetermined par-three hole upon which the contest or challenge is to be conducted or played, he will insert his card into the card reader 40, or alternatively, insert his data into the tee unit 30 by means of the keypad 38. The tee unit 30 will validate his card or data entry, communicate such validated entry back to the club house terminal 12, and also activate the green unit 50 and the security cameras 94 and 96. The golfer must then tee off within a specified time period during which the green unit 50 and the security cameras 94 and 96 are maintained active. In lieu of the green unit 50 being immediately activated by means of the validated entry data, the green unit 50 may be activated only upon the golfer actually driving the golf ball from the tee as determined by the sound detection means of the tee unit. As a result of the activation of the green unit, the SONAR detection system of the green unit is activated, as well as the photodetection system thereof, and consequently, any holes-in-one, or golf balls landing upon the green within the specified distances of, for example, one, two, or three feet of the cup or hole 52, may be readily detected. This information is transmitted back to the tee unit 30 as well as to the club house terminal 12. Such information, transmitted to the tee unit 30, in addition to being recorded within the computer memory, may be displayed upon the display window or screen 42 so as to inform the participating golfer of his tee shot result. If no information is received and/or displayed upon the window or screen 42, the golfer is thus informed that his tee shot was neither a hole-in-one or within the specified distance to the cup or hole 52. The system will remain active for a predetermined period of time sufficient to permit the golf tee shot to reach the green and for the shot placement data to be sensed, recorded, and transmitted, and subsequently, the system will be rendered inactive until a new participating golfer activates the system again by inserting his game card or data into the tee unit 30.

Thus it may be seen that the foregoing fully describes a system for implementing and monitoring a hole-in-one or closest-to-the-pin challenge or contest for golfers upon a particular, predetermined or preselected par-three hole of the golf course upon which the system of the present invention has been installed. The precise terms of management of the system is outside the scope of this invention and will be left to the management of the particular golf course upon which the system of the present invention is to be installed, that is, the precise fees charged, the prize money awarded, the use of the course and system for annual hole-in-one contests or challenges, and the like. The system permits one or more golfers to participate in the hole-in-one or closest-to-the-pin challenges or contests, and the operation of the system is such as not to interfere with a round of golf, or disturb the continuity of the game, or interfere with the progress of subsequent groups of golfers.

Obviously, many modifications and variations of the present invention are possible in light of the foregoing teachings. It is therefore to be understood that within the scope of the appended claims, the present invention may be practiced otherwise than as specifically described herein.

What is claimed as new and desired to be protected by means of Letters Patent of the United States of America, is:

1. A golf tee shot-green placement monitoring system, comprising:

a golf ball cup member disposed upon a predetermined green area of a predetermined hole of a golf course;

means disposed upon said predetermined green area of said predetermined hole of said golf course for determining the condition placement of a tee shot of golf ball by a golfer from a tee area of said predetermined hole of said golf course as being either within said cup member as a hole-in-one tee shot or within a specified distance upon said green area of said predetermined hole of said golf course from said cup member; and means disposed upon said tee area of said predetermined hole of said golf course for activating said means disposed upon said green area of said predetermined hole of said golf course during a predetermined time period which extends from the time said golfer arrives at said tee area of said predetermined hole of said golf course to when said golfer drives his tee shot from said tee area of said predetermined hole of said golf course to said predetermined green area of said predetermined hole of said golf course.

2. The system as set forth in claim 1, wherein:

said means disposed upon said predetermined green area comprises photodetector means disposed within golf ball cup member for determining the presence of a golf ball within said golf ball cup member and thereby confirm that said tee shot of said golfer comprises a hole-in-one golf tee shot.

3. The system as set forth in claim 2, further comprising:

inclined ramp means disposed within said golf ball cup member for causing said golf ball, within said cup member, to be disposed toward one side of said cup member; and recess means defined within a low end portion of said inclined ramp means and disposed within the vicinity of said photodetector means for insuring said golf ball, disposed within said cup member, is properly located with respect to said photodetector means.

4. The system as set forth in claim 1, further comprising:

a flag pole mounted within said golf ball cup member;

ultrasonic ranging means disposed within said flag pole for determining the distance of said golf ball tee shot, placed upon said green by said golfer, from said cup member in order to determine whether said golf ball of said golf ball tee shot is within said specified distance from said cup member.

5. The system as set forth in claim 4, wherein said ultrasonic ranging means comprises:

an ultrasonic transceiver for transmitting and receiving ultrasonic signals out from said flag pole toward said predetermined green area and into said flag pole from said predetermined green area;

reflector means operatively associated with said ultrasonic transceiver for reflecting said ultrasonic signals from said ultrasonic transceiver toward said predetermined green area, and from said predetermined green area toward said ultrasonic transceiver; and motor drive means operatively connected to said reflector means for rotatably driving said reflector means in a circular sweep mode such that said ultrasonic signals are transmitted out to and received back from all regions of said predetermined green area.

6. The system as set forth in claim 5, further comprising:

an annular array of apertures defined within a peripheral wall portion of said flag pole for permitting said ultrasonic signals to be transmitted outwardly from said flag pole toward said predetermined green area, and for permitting said ultrasonic signals to be received from said predetermined green area back into said flag pole.

7. The system as set forth in claim 1, further comprising:

first computer means for issuing a game card, having encoded data thereon with respect to said golfer, to said golfer for enabling said golfer to participate in a hole-in-one contest comprising placing said tee shot directly within said cup member, and a closest-to-the-pin contest comprising placing said tee shot within said specified distance from said cup member of said predetermined hole of said golf course; and said means disposed upon said tee area comprises second computer means for accepting said encoded data from said game card, comparing said accepted encoded data with said encoded data of said first computer means, and verifying the validity of said game card whereby said means disposed upon said tee area can subsequently activate said means disposed upon said predetermined green area.

8. The system as set forth in claim 7, wherein:

said game card has said encoded data printed thereon in alphanumeric form; and said second computer means disposed at said tee area comprises a keypad for entering said encoded data.

9. The system as set forth in claim 7, wherein:

said game card has said encoded data entered thereon in a format comprising one of a bar code and a magnetic strip; and said second computer means disposed at said tee area comprises a card reader into which said game card is inserted for reading said encoded data thereon.

10. The system as set forth in claim 7, further comprising:

third computer means incorporated within said means disposed upon said predetermined green area for recording a plurality of condition placements of different tee shots of different golfers from said tee area of said predetermined hole to said predetermined green area of said predetermined hole of said golf course.

11. The system as set forth in claim 10, further comprising:

communication links defined between said first, second, and third computer means whereby data concerning said plurality of condition placements of said different tee shots of said different golfers can be transmitted from said third computer means disposed upon said predetermined green area to said second computer means disposed upon said tee area such that said different golfers are informed of the condition placements of their tee shots, respectively, and to said first computer means, which is disposed within a club house of said golf course, so as to inform club house personnel of said condition placements of said tee shots of said golfers.

12. The system as set forth in claim 11, wherein:

said communication links comprises two-way radio frequency communication links.

13. The system as set forth in claim 11, wherein:

said means disposed upon said tee area comprises display means for displaying said data transmitted from said predetermined green area to said tee area concerning said condition placements of said tee shots.

14. The system as set forth in claim 1, further comprising:

video camera means disposed within the vicinity of said tee area and said predetermined green area for videotaping said golf tee shots of said golfers in order to insure the integrity of said golf tee shots placed upon said predetermined green area by said golfers.

15. A flag pole unit for use in connection with a predetermined green area of a predetermined hole of a golf course, comprising:

a golf ball cup member adapted to be disposed within a ground portion of a predetermined green area of a predetermined hole of a golf course;

a flag pole assembly adapted to be disposed within said golf ball cup member such that a first lower end portion of said flag pole assembly is mounted within said golf ball cup member, while a second upper end portion of said flag pole assembly projects above said golf ball cup member and the ground portion of said predetermined green area of said predetermined hole of said golf course; and means operatively connected to said golf ball cup member and to said flag pole assembly for determining the condition placement of a tee shot of a golf ball by a golfer from a tee area of said predetermined hole of said golf course as being either within said cup member as a hole-in-one tee shot or within a specified distance upon said predetermined green area of said predetermined hole of said golf course from said cup member.

16. The unit as set forth in claim 15, wherein:

said means for determining said condition placement of said tee shot comprises photodetector means disposed within said golf ball cup member for determining the presence of a golf ball within said golf ball cup member whereby said tee shot of said golfer is able to be confirmed as a hole-in-one tee shot.

17. The unit as set forth in claim 16, further comprising:

inclined ramp means disposed within said golf ball cup member for causing said golf ball, within said cup member, to be disposed toward one side of said cup member; and recess means defined within a low end portion of said inclined ramp means and disposed within the vicinity of said photodetector means ror insuring said golf ball, disposed within said cup member, is properly located with respect to said photodetector means.

18. The unit as set forth in claim 15, wherein:

said means for determining said condition placement of said tee shot comprises ultrasonic ranging means disposed within said second upper end portion of said flag pole assembly for determining the distance of said golf ball tee shot, placed upon said green by said golfer, from said cup member in order to determine whether said golf ball of said golf ball tee shot is within said specified distance from said cup member.

19. The unit as set forth in claim 18, wherein said ultrasonic ranging means comprises:

an ultrasonic transceiver for transmitting and receiving ultrasonic signals out from said flag pole assembly toward said predetermined green area, and into said flag pole assembly from said predetermined green area;

reflector means operatively associated with said ultrasonic transceiver for reflecting said ultrasonic signals from said ultrasonic transceiver toward said predetermined green area, and from said predetermined green area toward said ultrasonic transceiver; and motor drive means operatively connected to said reflector means for rotatably driving said reflector means in a circular sweep mode such that said ultrasonic signals are transmitted out to and received back from all regions of said predetermined green area.

20. The unit as set forth in claim 19, further comprising:

an annular array of apertures defined within a peripheral wall portion of said flag pole assembly for permitting said ultrasonic signals to be transmitted outwardly from said flag pole assembly toward said predetermined green area, and for permitting said ultrasonic signals to be received from said predetermined green area back into said flag pole assembly.

* * * * *